US011331672B2

(12) United States Patent
Ku et al.

(10) Patent No.: US 11,331,672 B2
(45) Date of Patent: May 17, 2022

(54) PILLAR STRUCTURE FOR BIOCHIP

(71) Applicant: MBD KOREA. CO., LTD., Yongin-si (KR)

(72) Inventors: Bo Sung Ku, Yongin-si (KR); Dong Woo Lee, Suwon-si (KR)

(73) Assignee: MBD KOREA. CO., LTD., Yongin-si (KR)

( * ) Notice: Subject to any disclaimer, the term of this patent is extended or adjusted under 35 U.S.C. 154(b) by 423 days.

(21) Appl. No.: 16/085,873

(22) PCT Filed: Jan. 30, 2018

(86) PCT No.: PCT/KR2018/001264
§ 371 (c)(1),
(2) Date: Sep. 17, 2018

(87) PCT Pub. No.: WO2018/174399
PCT Pub. Date: Sep. 27, 2018

(65) Prior Publication Data

US 2020/0376484 A1 Dec. 3, 2020

(30) Foreign Application Priority Data

Mar. 23, 2017 (KR) ..... 10-2017-0036557

(51) Int. Cl.
*B01L 3/00* (2006.01)

(52) U.S. Cl.
CPC ..... *B01L 3/5085* (2013.01); *B01L 2300/0819* (2013.01); *B01L 2300/0829* (2013.01); *B01L 2300/0848* (2013.01)

(58) Field of Classification Search
CPC ..... B01L 2300/0609; B01L 2200/0689; B01L 2300/042
USPC ..... 422/552, 550
See application file for complete search history.

(56) References Cited

U.S. PATENT DOCUMENTS 4,902,481 A * 2/1990 Clark ..... B01D 61/18 210/335
2005/0239197 A1 10/2005 Katerkamp et al.

* cited by examiner

*Primary Examiner* — Natalia Levkovich
(74) *Attorney, Agent, or Firm* — Birch, Stewart, Kolasch & Birch, LLP

(57) ABSTRACT

The present invention relates to a pillar structure for a biochip, the pillar structure including: a substrate portion which has a plate-shaped structure; multiple pillar portions which protrude from one surface of the substrate portion and each of which has an end portion on which a sample is disposed; and smooth surface forming portions which are formed on the other surface of the substrate portion that defines the plate-shaped structure together with the one surface of the substrate portion, the smooth surface forming portions forming smooth surfaces each having a relatively concave groove shape at a portion corresponding to a circumferential surface of each of the pillar portions.

2 Claims, 6 Drawing Sheets

PILLAR STRUCTURE FOR BIOCHIP

CROSS REFERENCE TO RELATED APPLICATIONS

This application is the National Phase of PCT International Application No. PCT/KR2018/001264, filed on Jan. 30, 2018, which claims priority under 35 U.S.C. 119(a) to Patent Application No. 10-2017-0036557, filed in Republic of Korea on Mar. 23, 2017, all of which are hereby expressly incorporated by reference into the present application.

TECHNICAL FIELD

The present invention relates to a pillar structure for a biochip, and more particularly, to a pillar structure for a biochip which has an improved structure to improve measurement reliability by preventing distortion of an image of a pillar on which a sample is disposed.

BACKGROUND ART

A biochip is also called a biodevice and refers to a biological microchip that enables measurement and analysis of gene combinations, protein distributions, reaction modality, or the like in a state in which samples, that is, biological fine substances such as DNA, protein, and cells are disposed on a substrate. Such a biochip is widely used in fields such as scientific technologies and researches, new medicine development processes, and clinical diagnosis.

In general, as illustrated in FIGS. 1 and 2, a biochip includes a pillar plate 10 and a well plate 20. FIG. 1 is a perspective view for explaining the biochip in the related art, and FIG. 2 is a cross-sectional view taken along line II-II in FIG. 1. Referring to FIG. 1, the pillar plate 10 of the general biochip includes pillar portions 12 that protrude in the form of columns on one surface of a substrate portion 11. Meanwhile, the well plate 20 has multiple well portions 21.

A sample is disposed on an end portion of the pillar portion 12, and a culture solution is provided in the well portion 21. In the case of the general biochip as described above, the pillar plate 10 is disposed on the well plate 20, such that the sample disposed on the pillar portion 12 may be received in the well portion 21 in which the culture solution is provided. In addition, the biochip enables the sample to be measured by a microscope through the pillar portion 12 through which light penetrates (see FIG. 2).

The pillar plate 10 of the general biochip is manufactured by an injection molding method. The pillar plate 10 is contracted during hardening process of the injection molding, such that grooves, which are concavely recessed toward the pillar portions 12, are essentially provided in the other surface of the substrate portion 11 as illustrated in FIG. 2. As described above, the pillar plate (pillar structure) 10 of the general biochip has the grooves which are directed toward the pillar portions 12 and formed in the substrate portion 111 through which light penetrates, and as a result, there are problems in that an image of a pillar on which a sample is disposed is distorted, and measurement reliability and optical precision deteriorate. In addition, since the general pillar plate (pillar structure) 10 has the substrate portion only having a flat plate shape, there is a problem in that a surface of the substrate portion is scratched when the sample is cultured in a state in which biochips are stacked.

As a related art, Korean Patent No. 10-1632425 discloses "Biochip Structure" in which columns are provided on the substrate portion 11 of the pillar plate 10, but there are problems in that a loss of light is caused because of an increase in thickness of the pillar portion 12, and the protruding columns are often scratched when stacking the pillar plates. To solve the aforementioned problems, the present invention proposes a ring structure 103 to be described below.

DISCLOSURE

Technical Problem

Accordingly, the present invention has been made in an effort to solve the aforementioned problems, and an objective of the present invention is to provide a pillar structure for a biochip, which prevents distortion of an image of a pillar on which a sample is disposed, thereby improving measurement reliability and optical precision.

Another objective of the present invention is to provide a pillar structure for a biochip, which prevents a surface of a substrate portion having a pillar structure from being scratched when culturing samples in a state in which biochips are stacked.

The objectives of the present invention are not limited to the aforementioned objectives, and other objectives, which are not mentioned above, may be clearly understood by those skilled in the art from the following descriptions.

Technical Solution

To achieve the aforementioned objectives, a pillar structure for a biochip according to the present invention includes: a substrate portion which has a plate-shaped structure; multiple pillar portions which protrude from one surface of the substrate portion and each of which has an end portion on which a sample is disposed; and smooth surface forming portions which are formed on the other surface of the substrate portion that defines the plate-shaped structure together with the one surface of the substrate portion, the smooth surface forming portions forming smooth surfaces each having a relatively concave groove shape at a portion corresponding to a circumferential surface of each of the pillar portions.

The smooth surface forming portion may protrude from the other surface of the substrate portion in a direction opposite to a direction in which each of the pillar portions protrudes, and the smooth surface forming portion may be disposed to surround, in a circumferential direction, the smooth surface which is a part of the other surface of the substrate portion, such that the concave groove shape is formed.

The smooth surface forming portion may be formed in a convex spherical surface shape, such that the smooth surface forming portion is configured such that a straight distance in a diameter direction is gradually increased upward from the smooth surface.

The smooth surface forming portion may be formed not on a plane coplanar with the other surface of the substrate portion but on another plane protruding from the other surface of the substrate portion.

Advantageous Effects

According to the pillar structure for a biochip according to the present invention which is configured as described above, the pillar portions on which the samples are disposed are provided on the one surface of the substrate portion having a plate-shaped structure, the smooth surface forming portions are provided on the other surface of the substrate portion so as to correspond to the positions of the pillar portions to form the smooth surfaces at positions corresponding to the pillar portions, and the smooth surfaces are coplanar with the other surface of the substrate portion, such that it is possible to prevent distortion of an image of the pillar, on which the sample is disposed, by effectively allowing the light to penetrate through the pillar without refraction when measuring the sample by using a microscope, thereby improving measurement reliability and optical precision.

Further, according to the present invention, the smooth surface forming portions has a convex spherical surface shape and protrude from the other surface of the substrate portion corresponding to the positions connected to the pillar portions to form the smooth surfaces, and each of the smooth surfaces is formed in a relatively concave groove shape at a portion corresponding to the circumferential surface of each of the pillar portions, such that it is possible to prevent the smooth surface, through which the light penetrates when culturing the sample in a state in which the biochips are stacked, from being scratched, thereby deriving an effect of improving measurement precision.

The effects of the present invention are not limited to the aforementioned effects, and other effects, which are not mentioned above, may be clearly understood by those skilled in the art from the following descriptions.

DETAILED DESCRIPTION OF THE EMBODIMENTS

Hereinafter, a pillar structure for a biochip according to an exemplary embodiment of the present invention will be described in detail with reference to the accompanying drawings.

Figure 3:
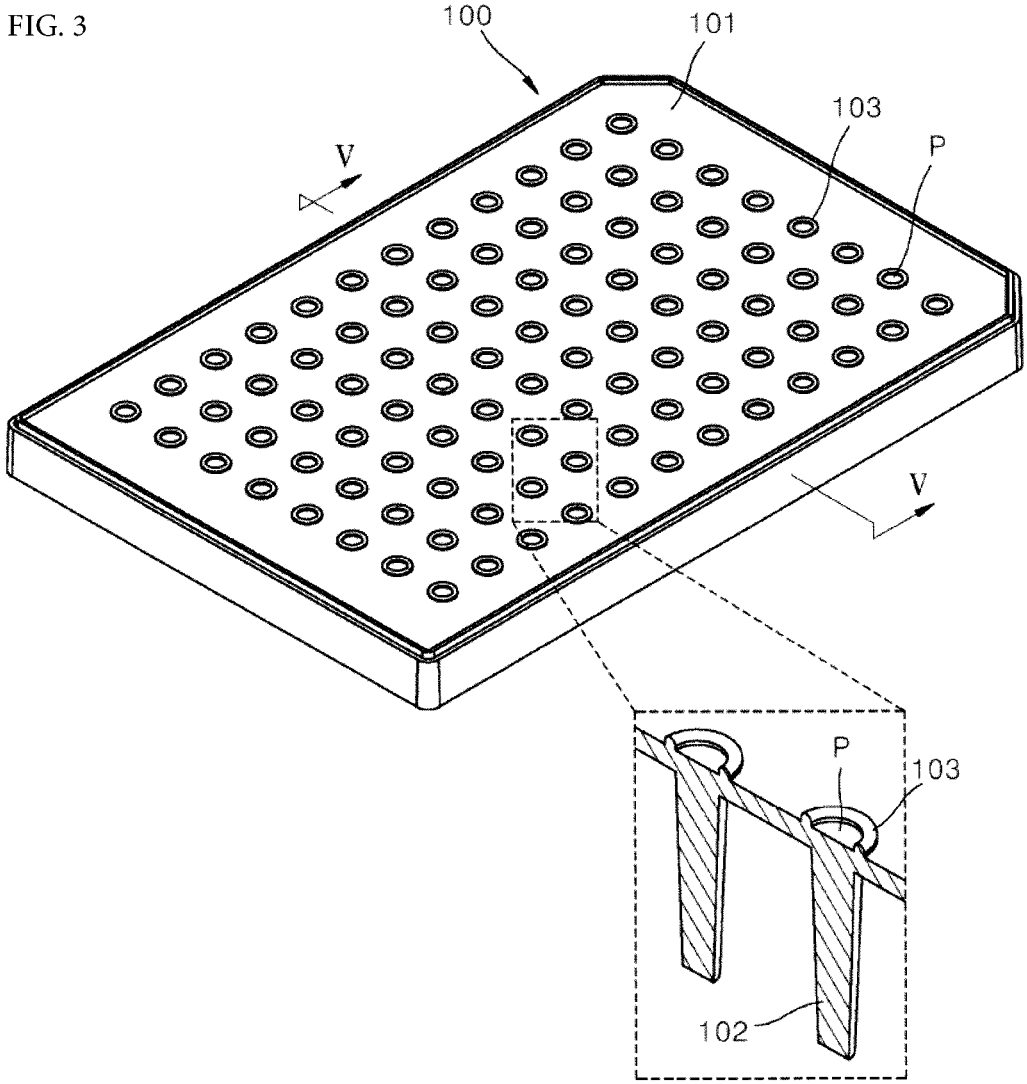
FIG. 3 is a perspective view of a pillar structure for a biochip according to an exemplary embodiment of the present invention.
Figure 4:
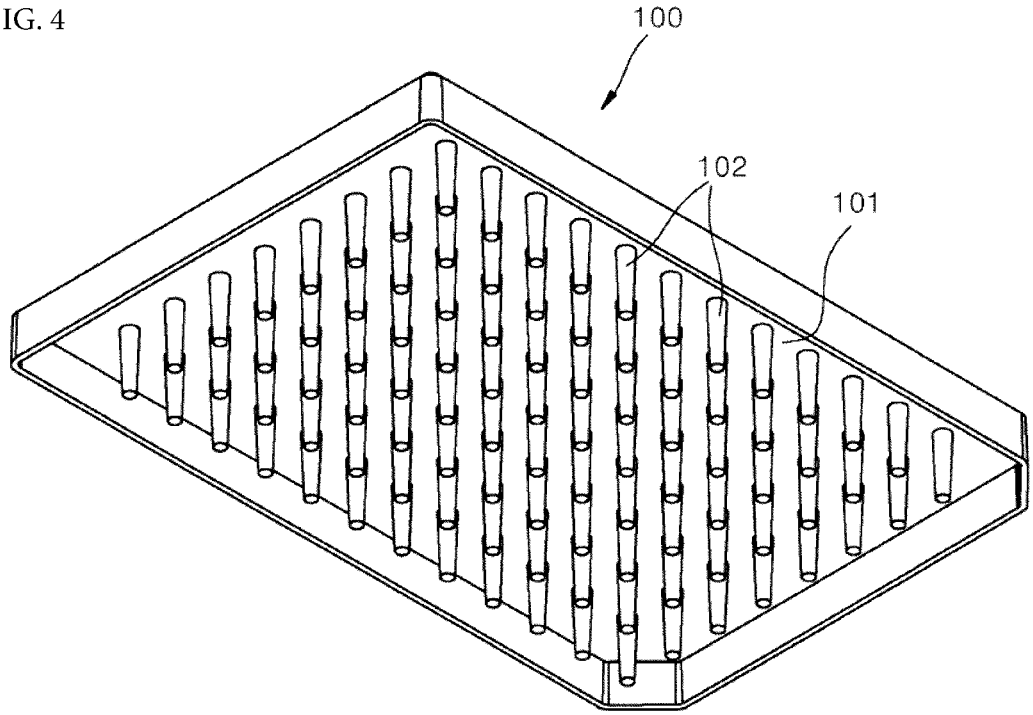
FIG. 4 is a perspective view for explaining in detail pillar portions applied to the exemplary embodiment of the present invention.
Figure 5:
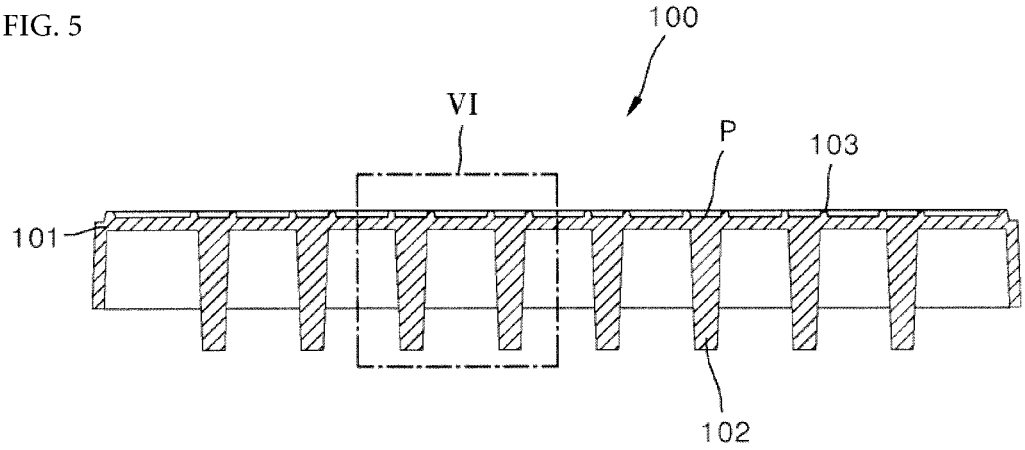
FIG. 5 is a cross-sectional view taken along line V-V in FIG. 3.
Figure 6:
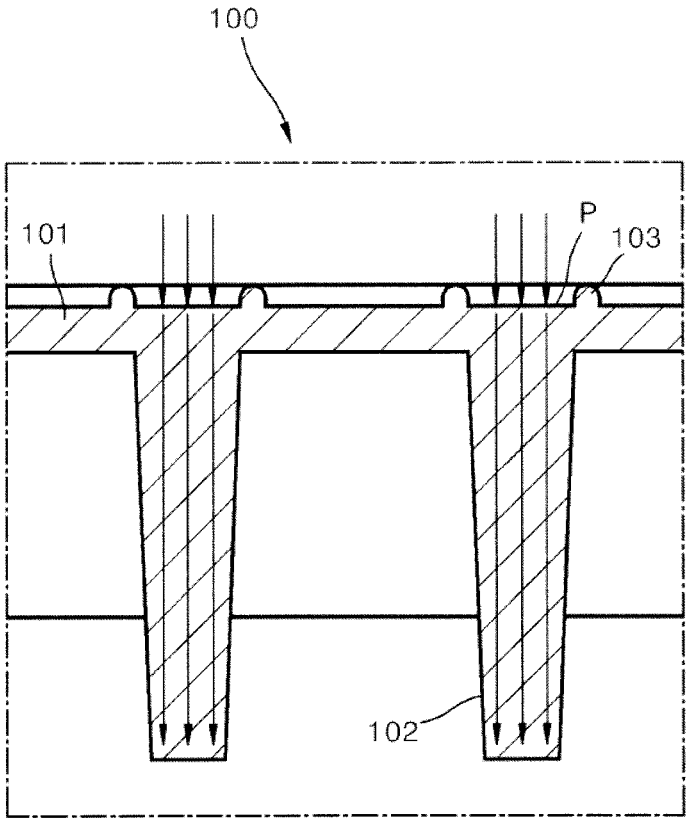
FIG. 6 is a partially enlarged view of part VI illustrated in FIG. 5.

FIG. 3 is a perspective view of a pillar structure for a biochip according to an exemplary embodiment of the present invention, FIG. 4 is a perspective view for explaining in detail pillar portions applied to the exemplary embodiment of the present invention, FIG. 5 is a cross-sectional view taken along line V-V in FIG. 3, and FIG. 6 is a partially enlarged view of part VI illustrated in FIG. 5.

As illustrated in these drawings, the pillar structure for a biochip according to the exemplary embodiment of the present invention includes a substrate portion 101 having a flat plate-shaped structure, multiple pillar portions 102, and smooth surface forming portions 103.

The substrate portion 101 has a flat plate-shaped structure and has the multiple pillar portions 102 formed on one surface thereof. The substrate portion 101 may be made of a resin composition material, with excellent light transmittance, such as polystyrene, maleic anhydride, fused-silica, quartz, polydimethylsiloxane (PDMS), or polymethylmethacrylate (PMMA), a polymeric material, or glass. The substrate portion 101 is a base on which the pillar portions 102 are provided, and the substrate portion 101 is configured such that light penetrates through the pillar portions 102.

Figure 1:
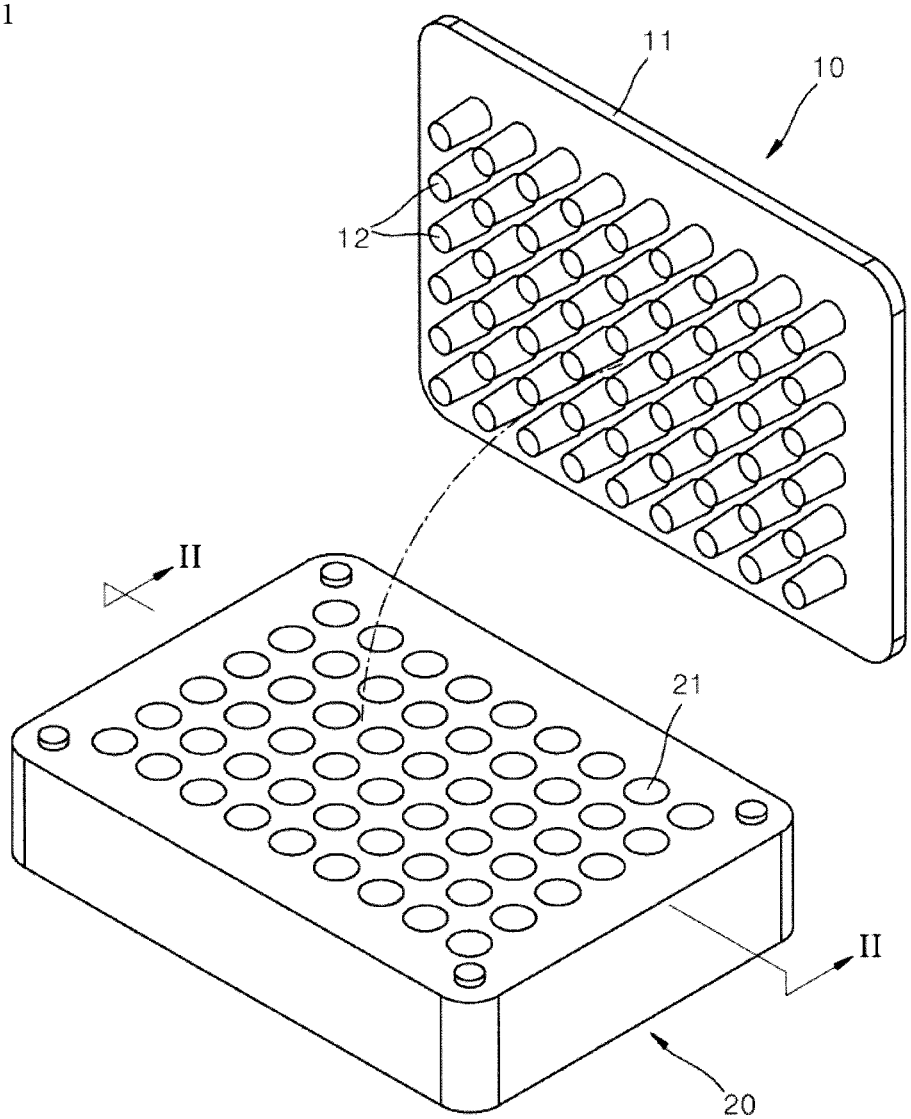
FIG. 1 is a perspective view for explaining a biochip in the related art.
Figure 2:
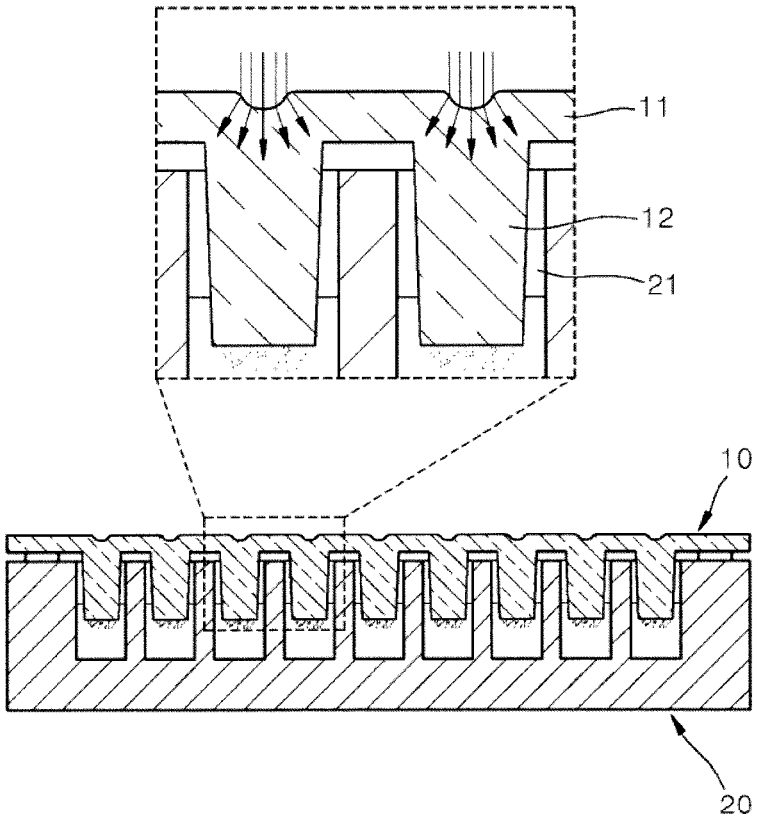
FIG. 2 is a cross-sectional view taken along line II-II in FIG. 1.

The pillar portions 102 are provided on one surface of the substrate portion 101, and the pillar portions 102 protrude from one surface of the substrate portion 101 (see FIG. 4). The pillar portion 102 is made of the same material as the substrate portion 101, and the pillar portion 102 may be made of a material that allows light to penetrate therethrough. A sample such as a cell is disposed at one end (end portion) of each of the pillar portions 102. The pillar portions 102 are disposed in groove portions (well portions) of a well plate (see reference numeral '20' in FIGS. 1 and 2) in a state in which the sample is supported on the end of each of the pillar portions 102, such that the sample may be cultured.

The pillar portions 102 are formed integrally with the substrate portion 101. The pillar portions 102 and the substrate portion 101 may be manufactured through various methods, but may be manufactured by an injection molding method using a mold (not illustrated). A straight distance in a diameter direction of the one end of the pillar portion 102 on which the sample is supported is shorter than a straight distance in a diameter direction of the other end connected to the substrate portion 101 (see FIGS. 3 and 5).

The pillar portions 102 having the aforementioned structure are disposed in the groove portions of the well plate without coming into contact with side surfaces of the groove portions, thereby ensuring sufficient spaces in the groove portions in which the samples are disposed. Further, the pillar portions 102 having the aforementioned structure may improve light concentration efficiency of the light that penetrates through the pillar portions 102 via the substrate portion 101.

The pillar portions 102 are disposed at intervals on one surface of the substrate portion 101. An interval between the pillar portions 102 corresponds to an interval between the groove portions formed in the well plate. Meanwhile, a length of the pillar portion 102 may be determined based on an interval between a bottom surface of the groove portion and the substrate portion 101 when the substrate portion 101 is disposed on the well plate 20. For example, a straight distance in a diameter direction of one end of the pillar portion 102 is shorter than a straight distance in a diameter direction of groove portion formed in the well plate. Further, the length of the pillar portion 102 is shorter than a length between the bottom surface of the groove portion and one surface of the substrate portion 101.

The smooth surface forming portions 103 are formed on the other surface of the substrate portion 101 and form the plate-shaped structure together with the other surface of the substrate portion 101. The ring structure 103 forms a flat disc shaped portion P with a relatively concave groove at a portion corresponding to a circumferential surface of each of the pillar portions 102. The smooth surface forming portions 103 are formed integrally with the substrate portion 101 by an injection molding method and manufactured together with the substrate portion 101 and the pillar portions 102.

Therefore, the ring structure 103 is made of the same material as the substrate portion 101 and the pillar portions 102.

The ring structure 103 protrudes from the other surface of the substrate portion 101 so as to have a predetermined height. In addition, the ring structure 103 is formed at a position corresponding to the other end of each of the pillar portions 102 connected to the substrate portion 101, and the ring structure 103 is structured to surround the other surface of the substrate portion 101, thereby dividing the other surface of the substrate portion 101 to form the flat disc shaped portion P (see FIGS. 5 and 6).

The flat disc shaped portion P is positioned on the other surface opposite to the one surface of the substrate portion 101 to which the pillar portions 102 are connected, and the flat disc shaped portion P is formed in a space inside the ring structure 103. The ring structure 103 is coplanar with the other surface of the substrate portion 101, but the smooth surface appears to have a concave groove shape because the smooth surface is formed inside the ring structure 103 (see FIG. 6).

According to the pillar structure 100 for a biochip according to the exemplary embodiment of the present invention which is configured as described above, the pillar portions 102 on which the samples are disposed are provided on the one surface of the substrate portion 101 having a plate-shaped structure, the smooth surface forming portions 103 are provided on the other surface of the substrate portion 101 so as to correspond to the positions of the pillar portions 102 to form the smooth surfaces P at positions corresponding to the pillar portions 102, and the smooth surfaces P are coplanar with the other surface of the substrate portion 101, such that it is possible to prevent distortion of an image of the pillar, on which the sample is disposed, by effectively allowing the light to penetrate through the pillar when measuring the sample by using a microscope, thereby improving measurement reliability and optical precision.

Further, according to the pillar structure 100 for a biochip according to the exemplary embodiment of the present invention, the flat and smooth surfaces P are formed by the smooth surface forming portions 103 on the other surface of the substrate portion 101 corresponding to the pillar portions 102, such that it is possible to shorten a route through which light penetrates through an optical unit, and it is possible to prevent distortion of images of a rim and a central portion of the pillar.

The aforementioned mold (not illustrated) for manufacturing the pillar structure 100 for a biochip according to the exemplary embodiment of the present invention is made of a metal material and has a mold space that corresponds to an external shape of the pillar structure 100 for a biochip. That is, the interior of the mold includes a substrate portion groove which corresponds to the substrate portion 101, pillar portion grooves which correspond to the pillar portions 102, and smooth surface forming portion grooves which correspond to the smooth surface forming portions 103.

Hereinafter, a process of manufacturing the pillar structure 100 for a biochip according to the present invention will be described. The process of manufacturing the pillar structure for a biochip broadly includes an injection step and a curing step.

The injection step injects a molten light transmissive material into the mold such that the substrate portion groove, the pillar portion grooves, and the smooth surface forming portion grooves are filled with the light transmissive material. The curing step is a step of curing the molten light transmissive material.

The pillar structure 100 for a biochip is manufactured by curing the light transmissive material in the curing step. In the curing step, the light transmissive material is contracted in the mold. In this process, the light transmissive materials, which fill the smooth surface forming portion grooves, are supported by the smooth surface forming portion grooves to maintain the shapes of the smooth surface forming portions 103 without being contracted in a direction in which the light transmissive materials face each other. Therefore, in the pillar structure 100 for a biochip according to the present invention, the smooth surface forming portions 103 are provided on the other surface of the substrate portion 101 corresponding to the circumferential surfaces of the pillar portions 102, and the smooth surfaces P are provided on the other surface of the substrate portion 101 by the smooth surface forming portions 103.

The smooth surface forming portions 103 protrude from the other surface of the substrate portion 101 in the direction opposite to the direction in which the pillar portions 102 protrude. In addition, the ring structure 103 is disposed on the other surface so as to surround, in the circumferential direction, the flat disc shaped portion P which is a part of the other surface of the substrate portion 101, thereby forming the flat disc shaped portion P having a concave shape. The smooth surface forming portions 103 protrude from the other surface of the substrate portion 101 corresponding to the positions connected to the pillar portions 102 to form the smooth surfaces P, and each of the smooth surfaces P is formed in a relatively concave groove shape at a portion corresponding to the circumferential surface of each of the pillar portions 102, such that it is possible to prevent the smooth surface, through which the light penetrates when culturing the sample in a state in which the biochips are stacked, from being scratched, thereby deriving an effect of improving measurement precision.

Referring to FIG. 6, the ring structure 103 has a convex spherical surface shape. Therefore, a straight distance in a diameter direction of the ring structure 103 is gradually increased upward from the flat disc shaped portion P. The ring structure 103 has a ring structure that surrounds the flat disc shaped portion P in the state in which the ring structure 103 has a convex spherical surface shape. Meanwhile, the ring structure 103 may have a structure that surrounds the flat disc shaped portion P while forming an interval in the state in which the ring structure 103 has a convex spherical surface shape.

The ring structure 103 applied to the present exemplary embodiment has a convex spherical surface shape and is structured to surround the flat disc shaped portion P, and the ring structure 103 forms the flat and flat disc shaped portion P by preventing the other surface of the substrate portion 101 corresponding to the pillar portions 102 from being contracted toward the pillar portions 102 in the curing step during the process of manufacturing the pillar structure 100 for a biochip, such that it is possible to improve light concentration efficiency by inducing light refraction toward the flat disc shaped portion P when the light for measuring the sample penetrates, and it is possible to prevent distortion of images caused by the rim and the central portion of each of the pillar portions 102, thereby improving measurement reliability and optical precision.

Figure 7:
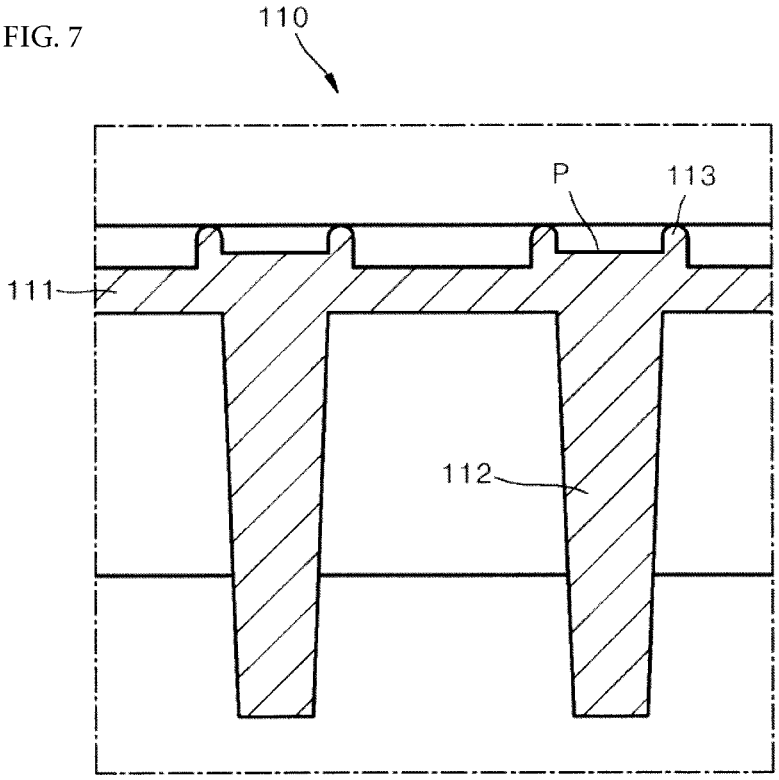
FIG. 7 is a cross-sectional view for explaining a smooth surface forming portion applied to another exemplary embodiment of the present invention.

The pillar structure 100 for a biochip according to the exemplary embodiment of the present invention has been described above. Hereinafter, a pillar structure 110 for a biochip according to another exemplary embodiment of the present invention will be described with reference to FIG. 7. FIG. 7 is a cross-sectional view for explaining a smooth surface forming portion applied to another exemplary embodiment of the present invention.

As illustrated in FIG. 7, most parts of the present exemplary embodiment are similar to the parts of the previous exemplary embodiment, but the present exemplary embodiment differs from the previous exemplary embodiment in terms of a structure of a flat disc shaped portion P formed by a smooth surface forming portion 113.

The smooth surface forming portion 113 applied to the present exemplary embodiment is formed on another plane that protrudes from the other surface of a substrate portion 111 at a position corresponding to each of pillar portions 112. Therefore, the flat disc shaped portion P is not coplanar with the other surface of the substrate portion 111 but positioned on the plane that protrudes while forming a level difference.

As described above, the smooth surface forming portion 113 protrudes from the other surface of the substrate portion 111, and the flat disc shaped portion P is formed in a flatwise manner on the other surface of the substrate portion 111 while forming a level difference, such that it is possible to prevent the other surface of the substrate portion 111 corresponding to the pillar portions 112 from being concavely recessed toward the pillar portions 112, thereby preventing distortion of an image of the pillar.

Another exemplary embodiment of the present invention has been described above. Hereinafter, a pillar structure 120 for a biochip according to still another exemplary embodiment of the present invention will be described with reference to FIG. 8.

Figure 8:
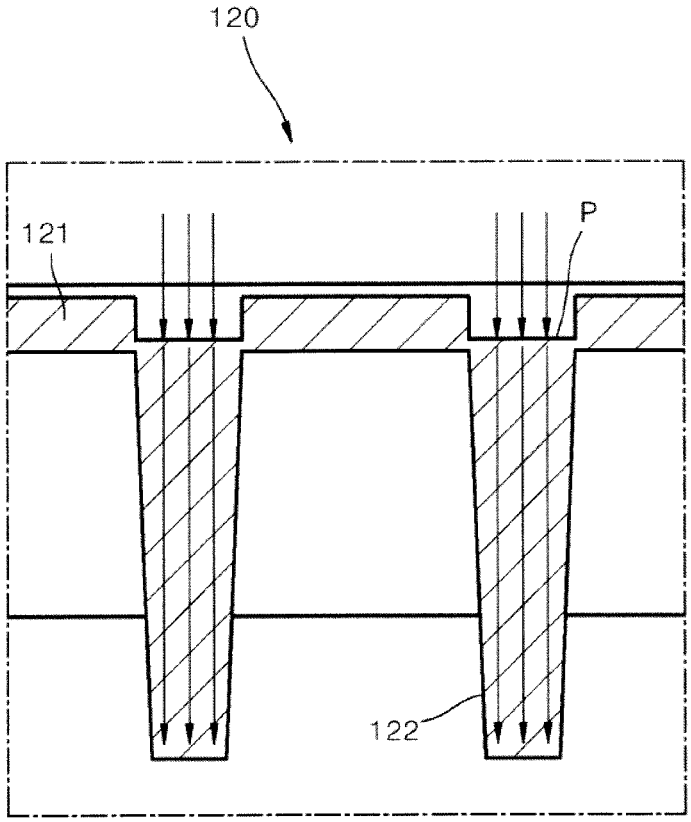
FIG. 8 is a cross-sectional view for explaining a smooth surface applied to still another exemplary embodiment of the present invention.

FIG. 8 is a cross-sectional view for explaining a smooth surface applied to still another exemplary embodiment of the present invention. As illustrated in FIG. 8, most parts of the present exemplary embodiment are similar to the parts of the previous exemplary embodiments, but the present exemplary embodiment differs from the previous exemplary embodiments in terms of a structure of a flat disc shaped portion P.

The flat disc shaped portion P applied to the present exemplary embodiment is not formed on a plane coplanar with the other surface of a substrate portion 121 but formed on another plane lower than the other surface of the substrate portion 121. By the substrate portion 121 having the other surface formed on a relatively higher plane while forming a level difference, the smooth surfaces P remain in a flat shape without being contracted toward pillar portions 122 during the process of manufacturing the pillar structure 120 for a biochip.

According to the pillar structure 120 for a biochip according to the present exemplary embodiment, the smooth surface P for light penetration has a flat surface and is formed on a plane lower than the other surface of the substrate portion 121, such that a penetration route of light is shortened, and as a result, it is possible to prevent distortion of an image of the pillar.

While the exemplary embodiments of the present invention have been described above, it is apparent that the present invention is not limited to the aforementioned exemplary embodiments but defined by the claims, and various modifications and alterations may be made by those skilled in the art to which the present invention pertains.

The invention claimed is:

1. A pillar structure for a biochip, the pillar structure comprising:

a substrate portion having a plate-shaped structure;

pillar portions protruding from one surface of the substrate portion and each of the pillar portions having an end portion for disposing a sample; and flat disc shaped portions formed on the other surface of the substrate portion, wherein each of the flat disc shaped portions is surrounded by a ring structure that protrudes from the other surface of the substrate portion in a direction opposite to a direction in which each of the pillar portions protrudes perpendicularly from the substrate portion, and wherein each of the flat disc shaped portions and the corresponding ring structure form a. concave groove.

2. The pillar structure of claim I, wherein an uppermost surface of each of the ring structure is disposed higher than an uppermost surface of each of the flat disc shaped portions.

* * * * *